US006869691B2

(12) United States Patent
Nagataki et al.

(10) Patent No.: US 6,869,691 B2
(45) Date of Patent: Mar. 22, 2005

(54) HIGH STRENGTH HOT-DIP GALVANIZED STEEL SHEET AND METHOD FOR MANUFACTURING THE SAME

(75) Inventors: Yasunobu Nagataki, Fukuyama (JP); Fusato Kitano, Fukuyama (JP); Kentaro Sato, Fukuyama (JP); Masahiro Iwabuchi, Fukuyama (JP); Akira Gamou, Fukuyama (JP)

(73) Assignee: NKK Corporation, Tokyo (JP)

( * ) Notice: Subject to any disclaimer, the term of this patent is extended or adjusted under 35 U.S.C. 154(b) by 75 days.

(21) Appl. No.: 10/273,052

(22) Filed: Oct. 17, 2002

(65) Prior Publication Data

US 2003/0106620 A1 Jun. 12, 2003

Related U.S. Application Data

(63) Continuation of application No. PCT/JP02/01711, filed on Feb. 26, 2002.

(30) Foreign Application Priority Data

Feb. 27, 2001 (JP) ..... 2001-051300

(51) Int. Cl.[7] ..... B32B 15/00; C21D 8/00; C22C 38/26

(52) U.S. Cl. ..... 428/659; 148/533; 148/333

(58) Field of Search ..... 148/533, 333; 428/659

(56) References Cited

U.S. PATENT DOCUMENTS

| | | | | |
|---|---|---|---|---|
| 6,695,932 | B2 * | 2/2004 | Kami et al. | 148/320 |
| 2002/0000266 | A1 | 1/2002 | Inoue et al. | |

FOREIGN PATENT DOCUMENTS

| | | | |
|---|---|---|---|
| EP | 1 143 022 | A | 10/2001 |
| JP | 05-311244 | A | 11/1993 |
| JP | 07-54051 | A | 2/1995 |
| JP | 11-236621 | A | 8/1999 |
| JP | 11-343538 | A | 12/1999 |
| JP | 2000-109951 | A | 4/2000 |
| JP | 2000-282175 | A | 10/2000 |

* cited by examiner

*Primary Examiner*—Deborah Yee
(74) *Attorney, Agent, or Firm*—Frishauf, Holtz, Goodman & Chick, P.C.

(57) ABSTRACT

The invention relates to a high strength hot-dip galvanized steel sheet consisting essentially of 0.03 to 0.25% C, 0.7% or less Si, 1.4 to 3.5% Mn, 0.05% or less P, 0.01% or less S, 0.05 to 1% Cr, 0.005 to 0.1% Nb, by mass, and balance of Fe, and being made of a composite structure of ferrite and secondary phase, and having an average grain size of the composite structure of 10 $\mu$m or smaller. Since the high strength hot-dip galvanized steel sheet of the present invention hardly induces softening at HAZ during welding, it is applicable to structural members of automobiles for "Tailor Welded Blanks" (TWB).

33 Claims, 2 Drawing Sheets

HIGH STRENGTH HOT-DIP GALVANIZED STEEL SHEET AND METHOD FOR MANUFACTURING THE SAME

This application is a continuation application of International Application PCT/JP02/01711 (not published in English) filed Feb. 26, 2002.

BACKGROUND OF THE INVENTION

1. Field of the Invention

The present invention relates to a high strength hot-dip galvanized steel sheet having tensile strength above 700 MPa, and particularly to a high strength hot-dip galvanized steel sheet that hardly induces softening at heat-affected zone (HAZ) during welding and that has excellent formability, and a method for manufacturing thereof.

2. Description of Related Arts

High strength hot-dip galvanized steel sheets having higher than 440 MPa of tensile strength are used in wide fields including construction materials, machine and structural members, and structural members of automobiles owing to the excellent corrosion resistance and the high strength.

Responding to ever-increasing severity of requirements on formability in recent years, various technologies to improve the formability of that type of high strength hot-dip galvanized steel sheet have been introduced. For example, according to JP-A-5-311244, (the term "JP-A" referred herein signifies the "unexamined Japanese patent publication"), a Si—Mn—P bearing hot-rolled steel sheet is heated to temperatures at or above Ac1 transformation point in a continuous hot-dip galvanizing line, and the heated steel sheet is quenched to Ms point or below to generate martensite over the whole or in a part thereof, then the martensite is tempered using the heat of the hot-dip galvanizing bath and of the alloying furnace. According to JP-A-7-54051, a hot-rolled steel sheet of Mn—P—Nb(—Ti) bearing is coiled at a low temperature after hot-rolled, which steel sheet is then subjected to hot-dip galvanizing to let pearlites or cementites disperse finely in the fine ferrite matrix to improve the stretch flangeability.

On the other hand, structural members of automobiles have recently been adopting steel sheets of different strength or different thickness which are joined together by laser welding or mush-seam welding, called "Tailor Welded Blanks" (TWB). Thus, the characteristics of welded part are also emphasized.

The high strength hot-dip galvanized steel sheet manufactured by the method disclosed in JP-A-5-311244 aiming at the improvement of formability of the steel sheet itself, however, is not applicable to the structural members of automobiles or the like because the softening at HAZ likely occurs during welding to induce degradation of formability and strength at the welded part. It is because, though the mechanism of strengthening is based on the second phase obtained by rapid-cooling austenite, the ferrite and the second phase are not fully homogeneously refined. The term "second phase" referred herein signifies a phase consisting of at least one structure selected from the group consisting of martensite and bainite. The high strength hot-dip galvanized steel sheet manufactured by the method disclosed in JP-A-7-54051 is difficult to stably have tensile strength exceeding 700 MPa, particularly above 780 MPa, because the structure thereof is a ferrite matrix with finely dispersed pearlites or cementites.

SUMMARY OF THE INVENTION

An object of the present invention is to provide a high strength hot-dip galvanized steel sheet that hardly induces softening at HAZ during welding, that has tensile strengths above 700 MPa, and that assures excellent formability, and a method for manufacturing thereof.

The object is attained by a high strength hot-dip galvanized steel sheet which consists essentially of 0.03 to 0.25% C, 0.7% or less Si, 1.4 to 3.5% Mn, 0.05% or less P, 0.01% or less S, 0.05 to 1% Cr, 0.005 to 0.1% Nb, by mass, and balance of Fe, and is made of a composite structure of ferrite and secondary phase, further has an average grain size of the composite structure of 10 $\mu$m or smaller.

The high strength hot-dip galvanized steel sheet can be manufactured by the method containing the steps of: hot-rolling a steel slab consisting essentially of 0.03 to 0.25% C, 0.7% or less Si, 1.4 to 3.5% Mn, 0.05% or less P, 0.01% or less S, 0.05 to 1% Cr, 0.005 to 0.1% Nb, by mass, and balance of Fe, at temperatures of Ar3 transformation point or above; cooling the hot-rolled steel sheet within a temperature range of 800° C. to 700° C. at a cooling rate of 5° C./sec or more, followed by coiling the cooled steel sheet at temperatures of 450° C. to 700° C.; and galvanizing the steel sheet after heating the steel sheet to a temperature range of 760° C. to 880° C., and by cooling the steel sheet to temperatures of 600° C. or below at a cooling rate of 1° C./sec or more in a continuous hot-dip galvanizing line.

DETAILED DESCRIPTION OF THE INVENTION

Figure 1:
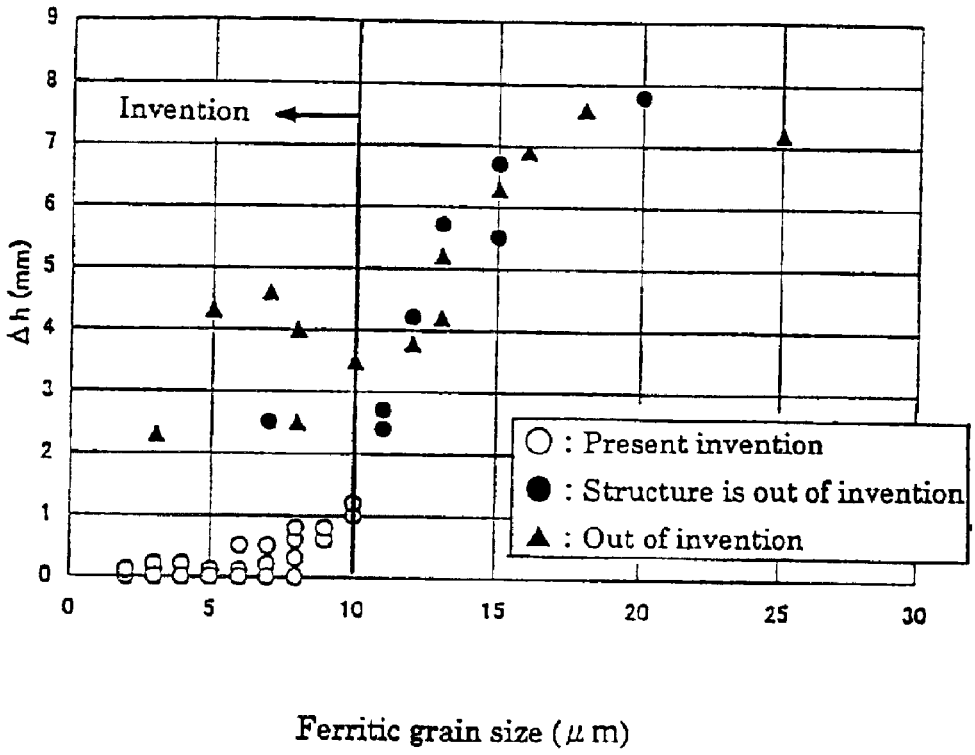
FIG. 1 is a graph showing the relation between Δh and average grain size of ferrite.

The inventors of the present invention studied the characteristics of high strength hot-dip galvanized steel sheets after welded, and found that the softening at HAZ during welding could be prevented and that excellent formability could be attained by adding Nb and Cr to the steel and by establishing a composite structure of ferrite and second phase, which composite structure has 10 $\mu$m or smaller average grain size. Owing to the presence of the hard second phase of martensite or bainite, giving high dislocation density, to the strengthening of secondary precipitation caused by Cr, and to the effect of suppressing recovery of dislocation caused by the fine NbC precipitation, the softening at HAZ could be prevented, and, further with the refinement of structure, the excellent formability could be attained. The detail description is given below.

1) Steel Compositions

The high strength hot-dip galvanized steel sheet according to the present invention consists essentially of the elements described below and balance of Fe.

C

Carbon is an essential element to attain high strength. To obtain tensile strengths above 700 MPa, the C content of 0.03% or more is necessary. If, however, the C content exceeds 0.25%, the volumetric percentage of the second phase increases to induce binding of grains to each other thus to increase the grain size, which induces softening at HAZ during welding and degrades the formability. Therefore, the C content is specified to a range of from 0.03 to 0.25%.

Si

Silicon is an effective element for stably attaining a ferrite+martensite dual phase structure. If, however, the Si content exceeds 0.7%, the adhesiveness of zinc coating and the surface appearance significantly degrade. Accordingly, the Si content is specified to 0.7% or less.

Mn

Manganese is an essential element for attaining high strength, similar with C. To obtain 700 MPa or higher tensile strength, at least 1.4% of the Mn content is required. If, however, the Mn content exceeds 3.5%, the grain size of the second phase increases to induce softening at HAZ during welding and to degrade the formability. Consequently, the Mn content is specified to a range of from 1.4 to 3.5%.

P

Phosphorus is an effective element for stably attaining a ferrite+martensite dual phase structure, similar with Si. If, however, the P content exceeds 0.05%, the toughness at the welded part degrades. Therefore, the P content is specified to 0.05% or less.

S

Since S is an impurity, smaller amount is more preferable. If the S content exceeds 0.01%, the toughness at the welded part significantly degrades, similar with P. Consequently, the S content is specified to 0.01% or less.

sol.Al

Although sol.Al is an effective element as deoxidizing element, over 0.10% of sol.Al content gives degraded formability. Accordingly, the sol.Al content is preferably 0.10% or less.

N

If N exists at a large amount exceeding 0.007%, the ductility degrades. So the N content is preferably 0.007% or less.

Cr

Chromium is an effective element for preventing softening at HAZ during welding. To attain the effect, the Cr content of 0.05% or more is necessary. If, however, the Cr content exceeds 1%, the surface property degrades. Therefore, the Cr content is specified to a range of from 0.05 to 1%.

Nb

Niobium is an effective element to prevent softening at HAZ during welding and to improve the formability by refining ferritic grains. To attain the effect, the Nb content of 0.005% or more if required. If, however, the Nb content exceeds 0.1%, the formability degrades. Therefore, the Nb content is specified to a range of from 0.005 to 0.1%.

Adding to these elements, if at least one element selected from the group consisting of 0.05 to 1% Mo, 0.02 to 0.5% V, 0.005 to 0.05% Ti, and 0.0002 to 0.002% B is added, it is more effective to further refine the ferritic grains to prevent softening at HAZ during welding and to improve the formability. In particular, Mo and V are effective to improve the hardenability, and Ti and B are effective to increase the strength.

2) Average Grain Size of Composite Structure Consisting of Ferrite+Second Phase

As described later, excellent formability is attained by making the average grain size of the composite structure 10 μm or less. The term "second phase" referred herein signifies a phase consisting of at least one structure selected from the group consisting of martensite and bainite. To the composite structure, less than 10% of pearlite or residual austenite may exist in addition to the second phase, which level thereof does not degrade the effect of the present invention.

3) Manufacturing Method

The above-described high strength hot-dip galvanized steel sheet may be manufactured by a method, for example, comprising the steps of: hot-rolling a steel slab satisfying the above-given requirement of compositions at finishing temperatures of Ar3 transformation point or above; cooling the hot-rolled steel sheet within a temperature range of 800° C. to 700° C. at a cooling rate of 5° C./sec or more; coiling the cooled steel sheet at temperatures of 450° C. to 700° C.; pickling the steel sheet; and galvanizing the pickled steel sheet after heating the pickled steel sheet to a temperature range of 760° C. to 880° C., and cooling the steel sheet to temperatures of 600° C. or below at a cooling rate of 1° C./sec or more in a continuous hot-dip galvanizing line. The method may further comprise a step of alloying the galvanized steel sheet. The high strength hot-dip galvanized steel sheet thus manufactured is a hot-rolled steel sheet.

If the finishing temperature of the hot-rolling becomes lower than the Ar3 transformation point, coarse ferritic grains are generated to form non-uniform structure, so the finishing temperature thereof is specified to Ar3 transformation point or above.

After the hot-rolling, ferritic grains are generated in a temperature range of from 800° C. to 700° C. If the cooling rate through the temperature range is less than 5° C./sec, the ferritic grains become coarse to form non-uniform structure. Consequently, the cooling is required to give at 5° C./sec or higher cooling rate. Particularly, the cooling rate between 100 and 300° C./sec is more preferable in terms of refinement of the structure.

If the coiling temperature is below 450° C., the precipitation of NbC becomes insufficient. If the coiling temperature exceeds 700° C., coarse NbC deposits to fail in refining the structure, which induces softening at HAZ during welding and degrading the formability. Consequently, the coiling temperature is specified to a range of from 450° C. to 700° C.

If the heating temperature in a continuous hot-dip galvanizing line is below 760° C., the second phase cannot be formed. If the heating temperature therein exceeds 880° C., the structure becomes coarse. Therefore, the heating temperature thereof is specified to a range of from 760° C. to 880° C.

After heating, even if the cooling is given at a cooling rate of less than 1° C./sec and at a cooling rate of 1° C./sec or more, when the galvanizing is given on the steel with a temperature of above 600° C., the ferritic grains become coarse or the second phase cannot be formed. Accordingly, the galvanizing is necessarily to be given after cooling the steel to 600° C. or lower at a cooling rate of 1° C./sec or more.

The hot-rolled steel sheet may be subjected to galvanizing under similar condition as above in a continuous hot-dip galvanizing line after cold-rolled. The high strength hot-dip galvanized steel sheet thus manufactured is a cold-rolled steel sheet. In the procedure, the cold-rolling reduction rate of 20% or more is necessary to prevent formation of coarse structure.

Alternatively, the slab may be manufactured by ingot-making process or continuous casting process. The hot-rolling may be conducted by continuous rolling process or direct rolling process. During the hot-rolling, the steel sheet may be reheated by an induction heater. Increase in the reduction rate during the hot-rolling is preferable in terms of refinement of structure. Before applying galvanizing in a continuous hot-dip galvanizing line, Ni plating may be applied.

EXAMPLE 1

Steels A through R in Table 1A which are within the range of the present invention and steels a through k in Table 1B which are outside the range of the present invention were prepared by melting in a converter, and were formed in slabs by continuous casting. The slabs were hot-rolled under the conditions of the present invention given in Table 2A, cold-rolled at a reduction rate of 60%, and then galvanized under the conditions of the present invention given in Table 2A using a continuous hot-dip galvanizing line, thus manufacturing high strength hot-dip galvanized steel sheets having 1.4 mm in thickness.

The second phase of each high strength hot-dip galvanized steel sheet was observed using an electron microscope. The residual austenite of each high strength hot-dip galvanized steel sheet was determined by an X-ray diffraction meter, and the tensile strength TS thereof was determined by a tensile test. To evaluate the characteristics at HAZ of each high strength hot-dip galvanized steel sheet after laser welding, Erichsen test was given to the mother material and to the laser-welded part to determine the formed height h0 of the mother material, the formed height ht of the welded part, and their difference Δh (=h0−ht).

The laser welding was carried out using carbon dioxide laser (10.6 μm in wavelength, ring mode M=2 of beam mode) and ZnSe lens (254 mm of focal distance) as the convergence system, while letting Ar gas flow as the shield gas at a flow rate of 20 l/min giving 4 kW of laser output and 4 m/min of welding speed.

With the steels C, I, J, Q, and d in Table 1A and Table 1B, high strength hot-dip galvanized steel sheets were prepared under the conditions given in Table 3A. The above-described tests were applied to each of thus prepared steel sheets.

The results are given in Table 2B and Table 3B.

As for the steel sheets having the composition and the size of ferrite and of second phase within the range of the present invention, the values of Δh were small, and the HAZ softening hardly occurred. On the other hand, for the steel sheets having these characteristics outside the range of the present invention, the values of Δh were large, and rapture occurred at HAZ.

FIG. 1 shows the relation between the value of Δh and the ferritic grain size of the steel sheets given in Table 2B and Table 3B.

The grain sizes of second phase are given in Table 2B and Table 3B.

When the steels having the compositions within the range of the present invention were used, and when the manufacturing conditions within the range of the present invention were applied to make the ferritic grain size and the grain size of second phase 10 μm or less, the obtained galvanized steel sheet showed no rapture at HAZ, gave 2 mm or smaller of Δh, gave high strength, and hardly induced HAZ softening.

To the contrary, the steel sheets having the compositions outside the range of the present invention and prepared by manufacturing conditions outside the range of the present invention gave above 2 mm of Δh, induced HAZ softening, and generated rupture in HAZ.

Figure 2A:
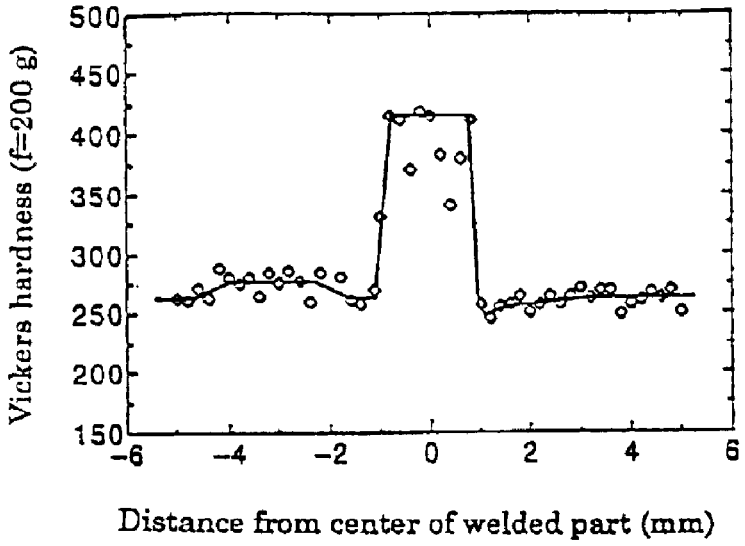
FIG. 2A and FIG. 2B are graphs showing the hardness profile on a laser-welded cross section of steel sheet of an example according to the present invention and a comparative example, respectively.
Figure 2B:
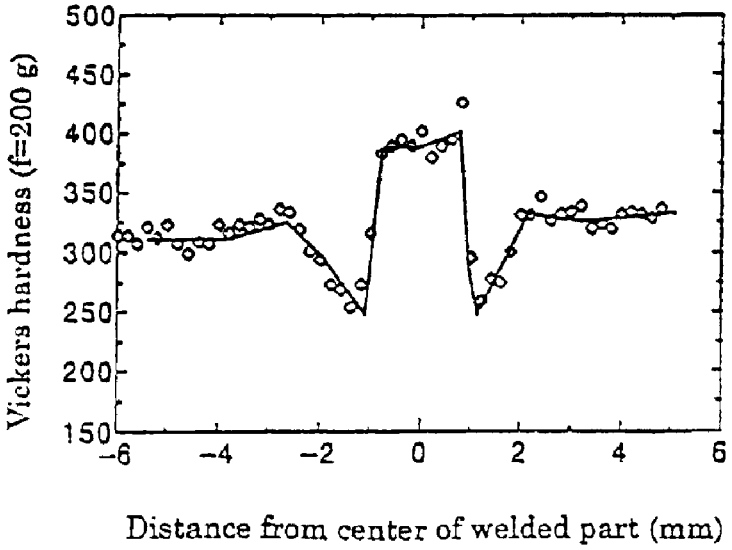

FIG. 2A and FIG. 2B show the graphs of the hardness profile on a laser-welded cross section of the steel sheet 17 according to the present invention and the steel sheet 28 as a comparative example, respectively.

The steel sheet according to the present invention gave very little HAZ softening.

TABLE 1A

| Steel | C | Si | Mn | P | S | sol.Al | N | Nb | Cr | Other | Remark |
|---|---|---|---|---|---|---|---|---|---|---|---|
| A | 0.05 | 0.12 | 2.4 | 0.030 | 0.001 | 0.020 | 0.0025 | 0.015 | 0.10 | — | Example |
| B | 0.13 | 0.01 | 3.3 | 0.010 | 0.0006 | 0.031 | 0.0014 | 0.043 | 0.20 | 0.07 V | Example |
| C | 0.08 | 0.36 | 2.0 | 0.014 | 0.001 | 0.014 | 0.0023 | 0.020 | 0.06 | — | Example |
| D | 0.11 | 0.10 | 1.8 | 0.016 | 0.003 | 0.019 | 0.0025 | 0.026 | 0.85 | 0.05 Mo | Example |
| E | 0.05 | 0.02 | 2.8 | 0.023 | 0.007 | 0.020 | 0.0036 | 0.010 | 0.07 | 0.01 Ti | Example |
| F | 0.19 | 0.25 | 2.2 | 0.026 | 0.003 | 0.021 | 0.0044 | 0.035 | 0.33 | — | Example |
| G | 0.08 | 0.63 | 3.0 | 0.030 | 0.002 | 0.032 | 0.0036 | 0.026 | 0.15 | 0.1 V | Example |
| H | 0.10 | 0.25 | 2.5 | 0.006 | 0.004 | 0.012 | 0.0021 | 0.031 | 0.05 | — | Example |
| I | 0.06 | 0.23 | 1.9 | 0.032 | 0.002 | 0.024 | 0.0020 | 0.058 | 0.40 | — | Example |
| J | 0.07 | 0.25 | 2.3 | 0.025 | 0.0002 | 0.022 | 0.0028 | 0.025 | 0.10 | 0.05 V | Example |
| K | 0.10 | 0.15 | 2.7 | 0.026 | 0.002 | 0.023 | 0.0011 | 0.020 | 0.55 | — | Example |
| L | 0.08 | 0.25 | 2.0 | 0.032 | 0.002 | 0.018 | 0.0048 | 0.045 | 0.15 | 0.15 Mo | Example |
| M | 0.04 | 0.10 | 1.4 | 0.019 | 0.001 | 0.031 | 0.0032 | 0.005 | 0.23 | 0.03 Ti, 0.000 5B | Example |
| N | 0.15 | 0.48 | 2.5 | 0.011 | 0.002 | 0.026 | 0.0033 | 0.018 | 0.07 | — | Example |
| O | 0.13 | 0.10 | 2.3 | 0.011 | 0.002 | 0.022 | 0.0015 | 0.046 | 0.10 | — | Example |
| P | 0.09 | 0.25 | 1.6 | 0.016 | 0.001 | 0.038 | 0.0019 | 0.040 | 0.20 | — | Example |
| Q | 0.13 | 0.05 | 2.5 | 0.029 | 0.006 | 0.031 | 0.0022 | 0.080 | 0.15 | 0.05 Ti, 0.000 3B | Example |
| R | 0.07 | 0.11 | 2.8 | 0.022 | 0.001 | 0.025 | 0.0019 | 0.033 | 0.20 | — | Example |

Unit is mass %.
*outside the range of the present invention.

TABLE 1B

| Steel | C | Si | Mn | P | S | sol.Al | N | Nb | Cr | Other | Remark |
|---|---|---|---|---|---|---|---|---|---|---|---|
| a | 0.14 | 0.15 | 1.3* | 0.021 | 0.003 | 0.030 | 0.0016 | 0.035 | — | — | Comparison |
| b | 0.07 | 0.13 | 2.5 | 0.020 | 0.0006 | 0.036 | 0.0021 | 0.003* | 0.20 | — | Comparison |
| c | 0.08 | 0.25 | 2.7 | 0.030 | 0.001 | 0.024 | 0.0022 | —* | 0.15 | 0.035 Ti | Comparison |
| d | 0.16 | 0.02 | 2.2 | 0.012 | 0.002 | 0.028 | 0.0030 | —* | —* | — | Comparison |
| e | 0.07 | 0.10 | 1.6 | 0.030 | 0.002 | 0.021 | 0.0019 | 0.015 | —* | — | Comparison |
| f | 0.12 | 0.01 | 3.7* | 0.016 | 0.001 | 0.023 | 0.0026 | 0.015 | 0.10 | 0.05 Ti, 0.0003 B | Comparison |
| g | 0.11 | 0.30 | 3.9* | 0.026 | 0.005 | 0.026 | 0.0022 | 0.038 | —* | — | Comparison |
| h | 0.13 | 0.01 | 1.6 | 0.016 | 0.001 | 0.019 | 0.0026 | 0.055 | —* | 0.21 Mo | Comparison |

TABLE 1B-continued

| Steel | C | Si | Mn | P | S | sol.Al | N | Nb | Cr | Other | Remark |
|---|---|---|---|---|---|---|---|---|---|---|---|
| I | 0.07 | 0.02 | 1.2* | 0.015 | 0.001 | 0.040 | 0.0041 | 0.050 | 0.35 | — | Comparison |
| j | 0.09 | 0.25 | 3.7* | 0.033 | 0.001 | 0.026 | 0.0029 | —* | 0.10 | — | Comparison |
| k | 0.05 | 0.45 | 2.1 | 0.045 | 0.003 | 0.028 | 0.0030 | —* | —* | 0.04 Ti | Comparison |

Unit is mass %.

*outside the range of the present invention.

TABLE 2A

| | | Hot-rolling condition | | | Cold-rolling | | Hot-dip galvanizing condition | | |
|---|---|---|---|---|---|---|---|---|---|
| Steel sheet | Steel | Heating temp. ° C. | Cooling rate ° C./sec | Coiling temp. ° C. | reduction rate % | Sheet thickness mm | Soaking temp. ° C. | Cooling rate ° C./sec | Alloying |
| 1 | A | 1220 | 10 | 580 | 60 | 1.4 | 800 | 7 | yes |
| 2 | B | 1260 | 10 | 630 | 60 | 1.4 | 800 | 7 | no |
| 3 | C | 1230 | 10 | 600 | 60 | 1.4 | 800 | 12 | yes |
| 4 | D | 1170 | 10 | 530 | 60 | 1.4 | 800 | 15 | yes |
| 5 | E | 1220 | 10 | 620 | 60 | 1.4 | 800 | 3 | yes |
| 6 | F | 1200 | 10 | 600 | 60 | 1.4 | 800 | 8 | yes |
| 7 | G | 1200 | 10 | 580 | 60 | 1.4 | 800 | 20 | yes |
| 8 | H | 1200 | 10 | 580 | 60 | 1.4 | 800 | 15 | no |
| 9 | I | 1200 | 10 | 580 | 60 | 1.4 | 800 | 10 | yes |
| 10 | J | 1200 | 10 | 580 | 60 | 1.4 | 800 | 10 | yes |
| 11 | K | 1200 | 10 | 580 | 60 | 1.4 | 800 | 2 | yes |
| 12 | L | 1270 | 10 | 580 | 60 | 1.4 | 800 | 7 | yes |
| 13 | M | 1230 | 10 | 580 | 60 | 1.4 | 800 | 25 | yes |
| 14 | N | 1200 | 10 | 580 | 60 | 1.4 | 800 | 20 | yes |
| 15 | O | 1200 | 10 | 550 | 60 | 1.4 | 800 | 10 | no |
| 16 | P | 1200 | 10 | 550 | 60 | 1.4 | 800 | 10 | no |
| 17 | Q | 1200 | 10 | 620 | 60 | 1.4 | 800 | 5 | yes |
| 18 | R | 1200 | 10 | 620 | 60 | 1.4 | 800 | 7 | yes |
| 19 | a | 1200 | 10 | 620 | 60 | 1.4 | 800 | 5 | yes |
| 20 | b | 1200 | 10 | 580 | 60 | 1.4 | 800 | 28 | yes |
| 21 | c | 1200 | 10 | 580 | 60 | 1.4 | 800 | 10 | no |
| 22 | d | 1200 | 10 | 580 | 60 | 1.4 | 800 | 13 | yes |
| 23 | e | 1200 | 10 | 580 | 60 | 1.4 | 800 | 9 | yes |
| 24 | f | 1280 | 10 | 600 | 60 | 1.4 | 800 | 5 | yes |
| 25 | g | 1200 | 10 | 600 | 60 | 1.4 | 800 | 27 | yes |
| 26 | h | 1200 | 10 | 600 | 60 | 1.4 | 800 | 10 | yes |
| 27 | I | 1200 | 10 | 600 | 60 | 1.4 | 800 | 10 | yes |
| 28 | j | 1200 | 10 | 600 | 60 | 1.4 | 800 | 10 | yes |
| 29 | k | 1200 | 10 | 600 | 60 | 1.4 | 800 | 10 | yes |

TABLE 2B

| | | Structure | | | | | Characteristics | | | | | |
|---|---|---|---|---|---|---|---|---|---|---|---|---|
| Steel sheet | Steel | Phase | Ferritic grain size μm | Second phase volumetric percentage % | Second phase grain size μm | Residual γ volumetric percentage % | TS MPa | h0 mm | ht mm | Δh mm | Position of rupture | Remark |
| 1 | A | F + M | 8 | 27 | 5 | 0 | 796 | 9.4 | 9.1 | 0.3 | Weld line | Example |
| 2 | B | F + M | 5 | 67 | 3 | 3 | 1152 | 6.9 | 6.8 | 0.1 | Weld line | Example |
| 3 | C | F + M + B | 9 | 23 | 7 | 0 | 739 | 9.8 | 9.2 | 0.6 | Weld line | Example |
| 4 | D | F + M | 7 | 32 | 5 | 1 | 889 | 8.8 | 8.8 | 0 | Weld line | Example |
| 5 | E | F + M | 10 | 38 | 8 | 1 | 861 | 9.0 | 8.0 | 1.0 | Weld line | Example |
| 6 | F | F + M + B | 6 | 55 | 4 | 6 | 1045 | 7.7 | 7.2 | 0.5 | Weld line | Example |
| 7 | G | F + M | 8 | 62 | 5 | 2 | 1097 | 7.3 | 7.3 | 0 | Weld line | Example |

TABLE 2B-continued

| | | Structure | | | | | Characteristics | | | | | |
|---|---|---|---|---|---|---|---|---|---|---|---|---|
| Steel sheet | Steel | Phase | Ferritic grain size μm | Second phase volumetric percentage % | Second phase grain size μm | Residual γ volumetric percentage % | TS MPa | h0 mm | ht mm | Δh mm | Position of rupture | Remark |
| 8 | H | F + M + B | 3 | 50 | 7 | 3 | 860 | 9.0 | 9.0 | 0 | Weld line | Example |
| 9 | I | F + M | 2 | 41 | 6 | 0 | 842 | 9.1 | 9.1 | 0 | Weld line | Example |
| 10 | J | F + M | 4 | 46 | 5 | 1 | 815 | 9.3 | 9.1 | 0.2 | Weld line | Example |
| 11 | K | F + M | 7 | 65 | 9 | 1 | 1079 | 7.5 | 7.3 | 0.2 | Weld line | Example |
| 12 | L | F + M + B | 5 | 33 | 5 | 0 | 815 | 9.3 | 9.3 | 0 | Weld line | Example |
| 13 | M | F + M + B | 10 | 28 | 8 | 0 | 764 | 9.7 | 8.5 | 1.2 | Weld line | Example |
| 14 | N | F + M | 8 | 46 | 4 | 3 | 959 | 8.3 | 7.7 | 0.6 | Weld line | Example |
| 15 | O | F + M + B | 5 | 31 | 7 | 2 | 847 | 9.1 | 9.1 | 0 | Weld line | Example |
| 16 | P | F + M | 3 | 25 | 10 | 0 | 719 | 10.0 | 9.9 | 0.1 | Weld line | Example |
| 17 | Q | F + M | 3 | 55 | 3 | 4 | 1071 | 7.5 | 7.3 | 0.2 | Weld line | Example |
| 18 | R | F + M | 6 | 43 | 5 | 1 | 977 | 8.2 | 8.1 | 0.1 | Weld line | Example |
| 19 | a | F + P | 8 | — | — | 0 | 552 | 11.1 | 8.6 | 2.5 | HAZ | Comparison |
| 20 | b | F + M | 12 | 39 | 15 | 1 | 905 | 8.7 | 4.9 | 3.8 | HAZ | Comparison |
| 21 | c | F + M | 15 | 46 | 13 | 1 | 953 | 8.3 | 2.0 | 6.3 | HAZ | Comparison |
| 22 | d | F + M + B | 13 | 23 | 20 | 1 | 777 | 9.6 | 4.4 | 5.2 | HAZ | Comparison |
| 23 | e | F + M | 8 | 7 | 9 | 0 | 549 | 11.2 | 7.2 | 4.0 | HAZ | Comparison |
| 24 | f | F + M | 5 | 83 | 16 | 3 | 1323 | 5.7 | 1.4 | 4.3 | HAZ | Comparison |
| 25 | g | F + M | 3 | 65 | 25 | 5 | 1196 | 6.6 | 4.3 | 2.3 | HAZ | Comparison |
| 26 | h | F + M + B | 7 | 16 | 8 | 0 | 647 | 10.5 | 5.9 | 4.6 | HAZ | Comparison |
| 27 | i | F + P | 13 | — | — | 0 | 640 | 10.5 | 6.3 | 4.2 | HAZ | Comparison |
| 28 | j | F + M | 10 | 70 | 30 | 2 | 1181 | 6.7 | 3.2 | 3.5 | HAZ | Comparison |
| 29 | k | F + M + B | 16 | 20 | 13 | 1 | 710 | 10.0 | 3.1 | 6.9 | HAZ | Comparison |

F: ferrite,
M: martensite,
B: bainite,
P: pearlite

TABLE 3A

| | | Hot-rolling condition | | | Cold-rolling | | Hot-dip galvanizing condition | | |
|---|---|---|---|---|---|---|---|---|---|
| Steel sheet | Steel | Heating temp. ° C. | Cooling rate ° C./sec | Coiling temp. ° C. | reduction rate % | Sheet thickness mm | Soaking temp. ° C. | Cooling rate ° C./sec | Alloying |
| 41 | C | 1240 | 1 | 550 | 60 | 1.4 | 780 | 5 | yes |
| 42 | C | 1240 | 3 | 550 | 60 | 1.4 | 780 | 5 | yes |
| 43 | C | 1240 | 8 | 550 | 60 | 1.4 | 780 | 5 | yes |
| 44 | C | 1240 | 15 | 550 | 60 | 1.4 | 780 | 5 | yes |
| 45 | C | 1240 | 100 | 550 | 60 | 1.4 | 780 | 5 | yes |
| 46 | C | 1240 | 15 | 550 | — | 3.5 | 780 | 5 | no |
| 47 | C | 1240 | 15 | 550 | 10 | 3.15 | 780 | 5 | no |
| 48 | C | 1240 | 15 | 550 | 30 | 2.45 | 780 | 5 | no |
| 49 | C | 1240 | 15 | 550 | 80 | 0.7 | 780 | 5 | no |
| 50 | I | 1200 | 15 | 620 | — | 2.3 | 780 | 5 | yes |
| 51 | J | 1250 | 15 | 580 | 60 | 1.4 | 700 | 8 | yes |
| 52 | J | 1250 | 15 | 580 | 60 | 1.4 | 750 | 8 | yes |
| 53 | J | 1250 | 15 | 580 | 60 | 1.4 | 780 | 8 | yes |
| 54 | J | 1250 | 15 | 580 | 60 | 1.4 | 830 | 8 | yes |
| 55 | J | 1250 | 15 | 580 | 60 | 1.4 | 860 | 8 | yes |
| 56 | J | 1250 | 15 | 580 | 60 | 1.4 | 900 | 8 | yes |
| 57 | J | 1250 | 15 | 580 | 60 | 1.4 | 800 | 0.5 | yes |
| 58 | J | 1250 | 15 | 580 | — | 2.3 | 800 | 8 | yes |
| 59 | Q | 1200 | 10 | 400 | 60 | 1.4 | 780 | 5 | yes |
| 60 | Q | 1200 | 200 | 500 | 60 | 1.4 | 780 | 5 | yes |

TABLE 3A-continued

| Steel sheet | Steel | Hot-rolling condition: Heating temp. ° C. | Hot-rolling condition: Cooling rate ° C./sec | Hot-rolling condition: Coiling temp. ° C. | Cold-rolling reduction rate % | Sheet thickness mm | Hot-dip galvanizing condition: Soaking temp. ° C. | Hot-dip galvanizing condition: Cooling rate ° C./sec | Alloying |
|---|---|---|---|---|---|---|---|---|---|
| 61 | Q | 1200 | 10 | 680 | 60 | 1.4 | 780 | 5 | yes |
| 62 | Q | 1200 | 10 | 600 | — | 3.5 | 780 | 5 | yes |
| 63 | d | 1250 | 15 | 580 | 60 | 1.4 | 900 | 8 | yes |
| 64 | d | 1250 | 15 | 580 | 10 | 3.15 | 800 | 8 | yes |

TABLE 3B

| Steel sheet | Steel | Structure: Phase | Structure: Ferritic grain size μm | Structure: Second phase volumetric percentage % | Structure: Second phase grain size μm | Structure: Residual γ volumetric percentage % | Characteristics: TS MPa | Characteristics: h0 mm | Characteristics: ht mm | Characteristics: Δh mm | Characteristics: Position of rupture | Remark |
|---|---|---|---|---|---|---|---|---|---|---|---|---|
| 41 | C | F + M + B | 15 | 26 | 12 | 0 | 730 | 9.0 | 2.3 | 6.7 | HAZ | Comparison |
| 42 | C | F + M + B | 13 | 23 | 10 | 0 | 725 | 9.2 | 3.5 | 5.7 | HAZ | Comparison |
| 43 | C | F + M + B | 9 | 25 | 8 | 0 | 720 | 10.1 | 9.3 | 0.8 | Weld line | Example |
| 44 | C | F + M + B | 7 | 24 | 7 | 0 | 733 | 9.8 | 9.3 | 0.5 | Weld line | Example |
| 45 | C | F + M + B | 3 | 27 | 5 | 0 | 735 | 10.3 | 10.3 | 0 | Weld line | Example |
| 46 | C | F + M + B | 7 | 25 | 8 | 0 | 720 | 11.5 | 11.3 | 0.2 | Weld line | Example |
| 47 | C | F + M + B | 20 | 22 | 13 | 0 | 715 | 8.9 | 1.1 | 7.8 | HAZ | Comparison |
| 48 | C | F + M + B | 8 | 26 | 10 | 0 | 726 | 10.8 | 10.0 | 0.8 | Weld line | Example |
| 49 | C | F + M + B | 3 | 25 | 5 | 0 | 725 | 9.5 | 9.5 | 0 | Weld line | Example |
| 50 | I | F + M | 5 | 38 | 6 | 0 | 820 | 9.2 | 9.2 | 0 | Weld line | Example |
| 51 | J | F + P | 11 | — | — | 0 | 1121 | 4.2 | 1.5 | 2.7 | HAZ | Comparison |
| 52 | J | F + P | 11 | — | — | 0 | 965 | 6.3 | 3.9 | 2.4 | HAZ | Comparison |
| 53 | J | F + M | 5 | 45 | 7 | 1 | 820 | 9.5 | 9.5 | 0 | Weld line | Example |
| 54 | J | F + M | 6 | 48 | 6 | 1 | 808 | 9.8 | 9.8 | 0 | Weld line | Example |
| 55 | J | F + M | 4 | 46 | 5 | 1 | 806 | 9.7 | 9.7 | 0 | Weld line | Example |
| 56 | J | F + M | 15 | 45 | 14 | 0 | 795 | 9.1 | 3.6 | 5.5 | HAZ | Comparison |
| 57 | J | F + P | 7 | — | — | 0 | 700 | 9.3 | 6.8 | 2.5 | HAZ | Comparison |
| 58 | J | F + M | 5 | 43 | 5 | 1 | 817 | 10.7 | 10.7 | 0 | Weld line | Example |
| 59 | Q | F + M | 12 | 50 | 8 | 3 | 1050 | 7.3 | 3.1 | 4.2 | HAZ | Comparison |
| 60 | Q | F + M | 2 | 53 | 3 | 4 | 1061 | 7.6 | 7.5 | 0.1 | Weld line | Example |
| 61 | Q | F + M | 4 | 48 | 6 | 4 | 1058 | 7.7 | 7.7 | 0 | Weld line | Example |
| 62 | Q | F + M | 7 | 51 | 5 | 3 | 1055 | 9.0 | 9.0 | 0 | Weld line | Example |
| 63 | d | F + M + B | 18 | 25 | 15 | 1 | 765 | 9.5 | 1.9 | 7.6 | HAZ | Comparison |
| 64 | d | F + M + B | 25 | 22 | 23 | 1 | 749 | 9.3 | 2.1 | 7.2 | HAZ | Comparison |

F: ferrite,
M: martensite,
B: bainite,
P: pearlite

What is claimed:

1. A high strength hot-dip galvanized steel sheet consisting essentially of 0.03 to 0.25% C, 0.7% or less Si, 1.4 to 3.5% Mn, 0.05% or less P, 0.1% or less S, 0.05 to 1% Cr, 0.005 to 0.1% Nb, by mass, optionally at least one element selected from the group consisting of Mo, V, Ti and B and a balance of Fe, and being made of a composite structure of ferrite and a secondary phase, the average grain size of the composite structure being 10 μm or smaller.

2. The high strength hot-dip galvanized steel sheet of claim 1 further containing at least one element selected from the group consisting of 0.05 to 1% Mo, 0.02 to 0.5% V, 0.005 to 0.05 Ti, and 0.0002 to 0.002% B, by mass.

3. A method for manufacturing the high strength hot-dip galvanized steel sheet of claim 1 comprising the steps of:

(a) hot-rolling a steel slab consisting essentially of 0.03 to 0.25% C, 0.7% or less Si, 1.4 to 3.5% Mn, 0.05% or less P, 0.01% or less S, 0.05 to 1% Cr, 0.005 to 0.1% Nb, by mass and a balance of Fe, at a temperature of Ar3 transformation point or above to provide a hot-rolled steel sheet;

(b) cooling the hot-rolled steel sheet within a temperature range of 800° to 700° C. at a cooling rate of 5° C./sec or more, followed by coiling the cooled steel sheet at a temperature of 450° C. to 700° C.;

(c) pickling the steel sheet to provide a pickled steel sheet; and (d) galvanizing the pickled steel sheet after heating the pickled steel sheet to a temperature range of 760° C. to 880° C., and cooling the steel sheet to a temperature of 600° C. or below at a cooling rate of 1° C./sec or more in a continuous hot-dip galvanizing line.

4. A method for manufacturing high strength hot-dip galvanized steel sheet of claim 2 comprising the steps of:

(a) hot-rolling a steel slab consisting essentially of 0.03 to 0.25% C, 0.7% or less Si, 1.4 to 3.5% Mn, 0.05% or less P, 0.01% or less S, 0.05 to 1% Cr, 0.005 to 0.1% Nb, further containing at least one element selected from the group consisting of 0.05 to 1% Mo, 0.02 to 0.5% V, 0.005 to 0.05% Ti, and 0.0002 to 0.002% B, by mass, and a balance of Fe, at a temperature of Ar3 transformation point or above to provide a hot-rolled steel sheet;

(b) cooling the hot-rolled steel sheet within a temperature range of 800° C. to 700° C. at a cooling rate of 5° C./sec or more, followed by coiling the cooled steel sheet at a temperature of 450° C. to 700° C.;

(c) pickling the steel sheet to provide a pickled steel sheet; and (d) galvanizing the pickled steel sheet after heating the pickled steel sheet to a temperature range of 760° C. to 880° C., and cooling the steel sheet to a temperature of 600° C. or below at a cooling rate of 1° C./sec or more in a continuous hot-dip galvanizing line.

5. The method for manufacturing high strength hot-dip galvanized steel sheet of claim 3 further comprising the step of cold-rolling the steel sheet at a reduction rate of 20% or higher between the step of pickling and the step of galvanizing.

6. The method for manufacturing high strength hot-dip galvanized steel sheet of claim 4 further comprising the step of cold-rolling the steel sheet at a reduction rate of 20% or higher between the step of pickling and the step of galvanizing.

7. The method for manufacturing high strength hot-dip galvanized steel sheet of claim 3 further comprising the step of alloying the galvanized steel sheet after the step of galvanizing.

8. The method for manufacturing high strength hot-dip galvanized steel sheet of claim 4 further comprising the step of alloying the galvanized steel sheet after the step of galvanizing.

9. The method for manufacturing high strength hot-dip galvanized steel sheet of claim 5 further comprising the step of alloying the galvanized steel sheet after the step of galvanizing.

10. The method for manufacturing high strength hot-dip galvanized steel sheet of claim 6 further comprising the step of alloying the galvanized steel sheet after the step of galvanizing.

11. The high strength hot-dip galvanized steel sheet of claim 1, wherein the steel contains 0.05 to 1 mass % Mo.

12. The high strength hot-dip galvanized steel sheet of claim 1, wherein the steel contains 0.02 to 0.5 mass % V.

13. The high strength hot-dip galvanized steel sheet of claim 1, wherein the steel contains 0.005 to 0.05 mass % Ti.

14. The high strength hot-dip galvanized steel sheet of claim 1, wherein the steel contains 0.0002 to 0.002% mass % B.

15. A high strength hot-dip galvanized steel sheet consisting essentially of 0.03 to 0.25% C, 0.7 or less Si, 1.4 to 3.5% Mn, 0.05% or less P, 0.01% or less S, 0.05 to 1% Cr, 0.005 to 0.1% Nb, 0.10% or less sol.Al, 0.007% or less N, by mass, optionally at least one element selected from the group consisting of Mo, V, Ti and B, and a balance of Fe, and being made of a composite structure of ferrite and a secondary phase, the average grain size of the composite structure being 10 $\mu$m or smaller.

16. The high strength hot-dip galvanized steel sheet of claim 15, wherein the steel contains 0.05% C, 0.12% Si, 2.4% Mn, 0.030% P, 0.001% S, 0.020% sol.Al, 0.0025% N, 0.015% Nb, 0.10% Cr, by mass, and a balance of Fe.

17. The high strength hot-dip galvanized steel sheet of claim 15, wherein the steel contains 0.13% C, 0.01% Si, 3.3% Mn, 0.010% P, 0.0006% S, 0.031% sol.Al, 0.0014% N, 0.043% Nb, 0.20% Cr, 0.07% V, by mass, and a balance of Fe.

18. The high strength hot-dip galvanized steel sheet of claim 15, wherein the steel contains 0.08% C, 0.36% Si, 2.0% Mn, 0.014% P, 0.001% S, 0.014% sol.Al, 0.0023% N, 0.020% Nb, 0.06% Cr, by mass, and a balance of Fe.

19. The high strength hot-dip galvanized steel sheet of claim 15, wherein the steel contains 0.11% C, 0.10% Si, 1.8% Mn, 0.016% P, 0.003% S, 0.019% sol.Al, 0.0025% N, 0.026% Nb, 0.85% Cr, 0.05% Mo, by mass, and a balance of Fe.

20. The high strength hot-dip galvanized steel sheet of claim 15, wherein the steel contains 0.05% C, 0.02% Si, 2.8% Mn, 0.023% P, 0.007% S, 0.020% sol.Al, 0.0036% N, 0.010% Nb, 0.07% Cr, 0.01% Ti, by mass, and a balance of Fe.

21. The high strength hot-dip galvanized steel sheet of claim 15, wherein the steel contains 0.19% C, 0.25% Si, 2.2% Mn, 0.026% P, 0.003% S, 0.021% sol.Al, 0.0044% N, 0.035% Nb, 0.33% Cr, by mass, and a balance of Fe.

22. The high strength hot-dip galvanized steel sheet of claim 15, wherein the steel contains 0.08% C, 0.63% Si, 3.0% Mn, 0.030% P, 0.002% S, 0.032% sol.Al, 0.0036% N, 0.026% Nb, 0.15% Cr, 0.1% V, by mass, and a balance of Fe.

23. The high strength hot-dip galvanized steel sheet of claim 15, wherein the steel contains 0.10% C, 0.25% Si, 2.5% Mn, 0.006% P, 0.004% S, 0.012% sol.Al, 0.0021% N, 0.031% Nb, 0.05% Cr, by mass, and a balance of Fe.

24. The high strength hot-dip galvanized steel sheet of claim 15, wherein the steel contains 0.06% C, 0.23% Si, 1.9% Mn, 0.032% P, 0.002% S, 0.024% sol.Al, 0.0020% N, 0.058% Nb, 0.40% Cr, by mass, and a balance of Fe.

25. The high strength hot-dip galvanized steel sheet of claim 15, wherein the steel contains 0.07% C, 0.25% Si, 2.3% Mn, 0.025% P, 0.0002% S, 0.022% sol.Al, 0.0028% N, 0.025% Nb, 0.10% Cr, 0.05% V, by mass, and a balance of Fe.

26. The high strength hot-dip galvanized steel sheet of claim 15, wherein the steel contains 0.10% C, 0.15% Si, 2.7% Mn, 0.026% P, 0.002% S, 0.023% sol.Al, 0.0011% N, 0.020% Nb, 0.55% Cr, by mass, and a balance of Fe.

27. The high strength hot-dip galvanized steel sheet of claim 15, wherein the steel contains 0.08% C, 0.25% Si, 2.0% Mn, 0.032% P, 0.002% S, 0.018% sol.Al, 0.0048% N, 0.045% Nb, 0.15% Cr, 0.15% Mo, by mass, and a balance of Fe.

28. The high strength hot-dip galvanized steel sheet of claim 15, wherein the steel contains 0.04% C, 0.10% Si, 1.4% Mn, 0.019% P, 0.001% S, 0.031% sol.Al, 0.0032% N, 0.005% Nb, 0.23% Cr, 0.03% Ti, 0.0005% B, by mass, and a balance of Fe.

29. The high strength hot-dip galvanized steel sheet of claim 15, wherein the steel contains 0.15% C, 0.48% Si, 2.5% Mn, 0.011% P, 0.002% S 0.026% sol.Al, 0.0033% N, 0.018% Nb, 0.07% Cr, by mass, and a balance of Fe.

30. The high strength hot-dip galvanized steel sheet of claim 15, wherein the steel contains 0.13% C, 0.10% Si, 2.3% Mn, 0.011% P, 0.002% S, 0.022% sol.Al, 0.0015% N, 0.046% Nb, 0.10% Cr, by mass, and a balance of Fe.

31. The high strength hot-dip galvanized steel sheet of claim 15, wherein the steel contains 0.09% C, 0.25% Si, 1.6% Mn, 0.016% P, 0.001% S, 0.038% sol.Al, 0.0019% N, 0.040% Nb, 0.20% Cr, by mass, and a balance of Fe.

32. The high strength hot-dip galvanized steel sheet of claim 15, wherein the steel contains 0.13% C, 0.05% Si, 2.5% Mn, 0.029% P, 0.006% S, 0.031% sol.Al, 0.0022% N, 0.080% Nb, 0.15% Cr, 0.05% Ti, 0.0003% B, by mass, and a balance of Fe.

33. The high strength hot-dip galvanized steel sheet of claim 15, wherein the steel contains 0.07% C, 0.11% Si, 2.8% Mn, 0.022% P, 0.001% S, 0.025% sol.Al, 0.0019% N, 0.033% Nb, 0.20% Cr, by mass, and a balance of Fe.

* * * * *